US007850747B2

(12) United States Patent
Dubs

(10) Patent No.: US 7,850,747 B2
(45) Date of Patent: Dec. 14, 2010

(54) SYSTEM FOR BLENDING AND STORING PETROLEUM BASED FUEL AND VEGETABLE OIL

(76) Inventor: Roy Dubs, 10 Wicasta Farm Rd., Hope Valley, RI (US) 02832

( * ) Notice: Subject to any disclaimer, the term of this patent is extended or adjusted under 35 U.S.C. 154(b) by 1167 days.

(21) Appl. No.: 11/499,417

(22) Filed: Aug. 4, 2006

(65) Prior Publication Data

US 2008/0028676 A1 Feb. 7, 2008

(51) Int. Cl.
*C10L 5/00* (2006.01)

(52) U.S. Cl. ..... 44/629

(58) Field of Classification Search ..... 44/629
See application file for complete search history.

(56) References Cited

U.S. PATENT DOCUMENTS 4,595,296 A * 6/1986 Parks ..... 366/106
6,979,426 B2 * 12/2005 Teall et al. ..... 422/237
2005/0132642 A1 6/2005 Gibson et al.

FOREIGN PATENT DOCUMENTS

JP 10219261 A 8/1998

* cited by examiner

*Primary Examiner*—Cephia D Toomer

(57) ABSTRACT

An apparatus for blending and storing petroleum based fuel and vegetable based fuel is provided. The apparatus includes a blended fuel storage tank; a petroleum fuel storage tank connectable to the blended fuel storage tank; a vegetable based fuel storage tank connectable to the blended fuel storage tank; and a ganged fuel controller adapted to synchronize fuel flow ratios from the petroleum fuel storage tank and the vegetable based fuel tank to the blended fuel storage tank. In an alternate embodiment the fuel may be delivered already mixed for storage and continued blending in a mixed fuel storage tank adapted to maintaining the blended fuel mixture.

9 Claims, 1 Drawing Sheet

SYSTEM FOR BLENDING AND STORING PETROLEUM BASED FUEL AND VEGETABLE OIL

BACKGROUND OF THE INVENTION

1. Field of the Invention

This invention relates to blending heating fuel, and particularly to blending petroleum based fuel and vegetable oil.

2. Description of Background

As noted in Patent Application Publication 20050132642, Renewable vegetable derived oil for use as residential heating oil alternative has the potential of reducing the demand for non-renewable petroleum oil. In particular soybeans, which made up 57% of the total world wide oilseed production of 2002, have produced promising results in lab and field tests at Purdue University. United States farmers harvested 72.16 million acres of soybeans with an average yield of 37.8 bushels/acre (USDA-NASS). The United States soybean oil and meal production industry produced 21.81 billion pounds of oil in 2002 utilizing an estimated 57 million acres of soybeans (USDA-NASS). This is equivalent to 2.91 billion gallons of soybean oil ready for industrial, commercial, and food product use.

Moreover, also according Patent Application Publication 20050132642 to the United States Department of Energy's Energy Information Administration, nearly 8.1 million homes used petroleum heating oil, also known as No. 2 fuel oil, in the year 2002. The primary area of market potential is in the Northeast and Midwest with 75% and 10% of the total household respectively. This trend is also supported by the national residential fuel oil consumption data.

Although it has been promoted mostly as a fuel for diesel-powered vehicles, biodiesel is perfectly suited as an additive or replacement fuel in a standard oil-fired furnace or boiler. When used as a heating fuel, biodiesel is sometimes referred to as "biofuel" or "bioheat." Made from new and used vegetable oils or animal fats, this fuel also has the advantage of being biodegradable, nontoxic and renewable: While fossil fuels took millions of years to produce, fuel stocks for biodiesel can be created in just a few months, and the plants grown to make biodiesel naturally balance the carbon dioxide emissions created when the fuel is combusted. What's more, the resulting fuel is far less polluting than its petroleum-based alternative.

As noted above, biodiesel is composed of long-chain fatty acids with an alcohol attached, an is often derived from vegetable oils. It is produced through the reaction of a vegetable oil with methyl alcohol or ethyl alcohol in the presence of a catalyst. Animal fats are another potential source. Commonly used catalysts are potassium hydroxide (KOH) or sodium hydroxide (NaOH). The chemical process is called transesterification which produces biodiesel and glycerin. Chemically, biodiesel is called a methyl ester if the alcohol used is methanol. If ethanol is used, it is called an ethyl ester. They are similar and currently, methyl ester is less expensive due to the lower cost for methanol. Biodiesel can be used in the pure form, or blended in any amount with diesel fuel for use in compression ignition engines.

However, it will be appreciated that crude vegetable oil and degummed vegetable oil blends are preferred over biodiesel blends since the vegetable oils are less expensive while providing similar heat content. It will be readily apparent that transesterified soybean oil, with its extra processing steps, will be more expensive than, for example, degummed soybean oil.

It will also be appreciated that owing to the different viscosities of the diesel fuel oil and the vegetable oil that there can be separation of the two blended oils over a period of time, leading to the fuel delivery system providing near pure vegetable oil to the heating system, thereby causing a malfunction in the heating system. Therefore there exists a need for initially blending the vegetable oil with the diesel fuel oil and keeping the oils blended over an extended period of time.

SUMMARY OF THE INVENTION

The shortcomings of the prior art are overcome and additional advantages are provided through the provision of blending and storing petroleum and vegetable oil. Further advantages are provided through the delivery of the blended fuel to a storage tank and to a blended fuel burner.

In accordance with one embodiment of the present invention a system for blending, storing, and delivering blended petroleum based fuel and vegetable based fuel to a fuel burner is provided. The system includes a blended fuel storage tank for storing the blended petroleum based fuel and vegetable based fuel and a blending device connectable to the blended fuel storage tank. The system also includes at least one fuel filter connectable to blended fuel tank for filtering water and contaminants from the blended petroleum based fuel and vegetable based fuel. In addition, the system includes a circulator pump connectable to fuel filter for circulating the blended petroleum based fuel and vegetable based fuel and also includes a T-valve connector connectable to the circulator, the fuel burner and the blended fuel storage tank. The system also includes a delivery truck adapted to blending the petroleum based fuel and the vegetable based fuel.

In accordance with another embodiment of the present invention, an apparatus for blending and storing petroleum based fuel and vegetable based fuel is provided. The apparatus includes a blended fuel storage tank; a petroleum fuel storage tank connectable to the blended fuel storage tank; a vegetable based fuel storage tank connectable to the blended fuel storage tank; and a ganged fuel controller adapted to synchronize fuel flow ratios from the petroleum fuel storage tank and the vegetable based fuel tank to the blended fuel storage tank. The ganged fuel controller synchronizes the fuel flow from each of the fuel tanks to the blended fuel tank in accordance with a desired fuel flow ratio of petroleum fuel to vegetable based fuel.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

Figure 1:
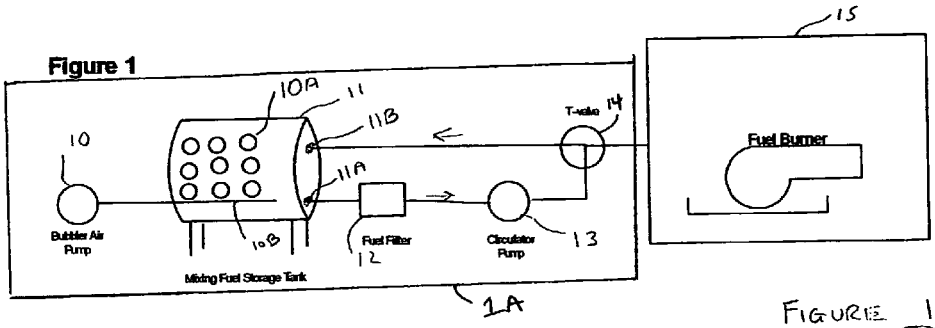
FIG. 1 is a pictorial diagram of a system for blending petroleum based fuel and vegetable oil incorporating features of the present invention.

Turning now to the drawings in greater detail, it will be seen that in FIG. 1 there is shown a pictorial diagram of a blended petroleum/vegetable oil fuel delivery system 1A. The petroleum based fuel can be selected from diesel fuel, fuel oil, and kerosene. The vegetable oil may be crude oil, degummed oil, or a mixture of crude and degummed oil and is selected from the group consisting of soybean oil, cotton seed oil, rapeseed oil, corn oil, peanut oil, sun flower seed oil, palm kernel oil, copra oil and other oils of similar composition produced by plants. In a preferred embodiment, the vegetable oil is present in an amount greater than zero and up to any suitable volume.

Still referring to FIG. 1, mixing fuel storage tank 11 holds a blended petroleum/vegetable oil fuel as described above. The blended ratio of petroleum to vegetable oil may be any suitable ratio. Mixing fuel storage tank may be any appropriate storage tank designed and/or approved by an approving body for the holding of fuel.

Air bubbler pump 10 is connectable to tank 11 to produce mixing bubbles 10A via air bubbler pump line 10B. It will be appreciated that mixing bubbles 10A may be any suitable diameter for mixing the desired blended ration of petroleum to vegetable oil.

Figure 3:
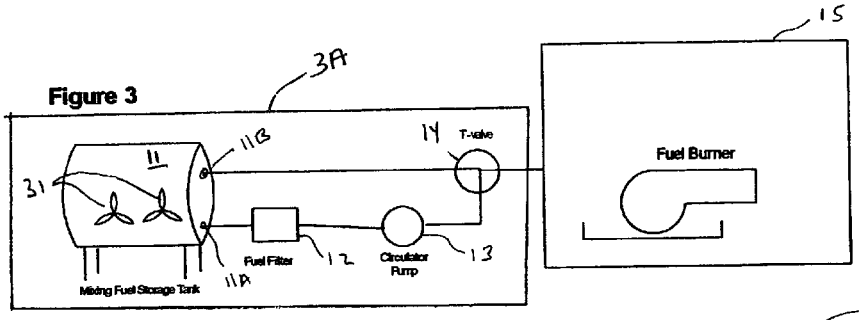
FIG. 3 illustrates one example of the mixing features in accordance with the present invention shown in FIG. 1.

It will also be appreciated, referring to FIG. 3 showing a pictorial diagram of a blended petroleum/vegetable oil fuel delivery system 3A that mixing or blending the petroleum with the vegetable oil may be accomplished by any suitable means. For example, splash mixing, or paddle mixers as shown in FIG. 3, items 31.

Blended fuel is drawn through outlet port 11A through fuel filter 12. Fuel filter 12 may be any suitable fuel filter such as, for example, a fuel filter/water separator.

Circulator pump 13 operates to circulate fuel from tank 11, through fuel filter 12, t-valve 14, and back to tank 11 through inlet port 11B. Circulator pump 13 may be any suitable pump for pumping blended petroleum/vegetable oil. It will also be appreciated that circulator pump 13 may have any suitable duty cycle for operating intermittently or non-intermittently.

Fuel burner 15 is any suitable oil burner or system requiring diesel fuel for operation, such as, for exemplar purposes only, heating systems such as forced hot air oil burner or a forced hot water oil burner, or a compression-ignition type internal combustion engine such as a diesel engine.

In a preferred heating system embodiment fuel burner 15 will have a higher operating pressure and decreased fuel nozzles (not shown) than standard fuel burners operating with non-blended fuel. It will be appreciated that best performance is achieved by having the return in the oil circulator 13 loop back to the tank 11 at the top of the tank 11 and the blended fuel to the burner near the bottom of the burner 15.

Figure 1B:
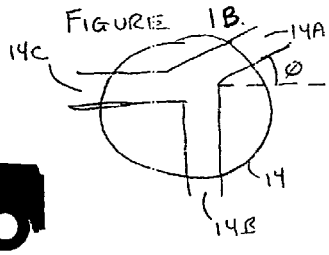
FIG. 1A is a schematic diagram of the T-valve feature in accordance with the present invention shown in FIG. 1.

Referring also to FIG. 1B, T-valve 14 may be any suitable T-valve which allows blended fuel in T-valve arm 14A to drain back into the center of T-valve 14 to be re-circulated with blended fuel through T-valve arms 14B and 14C. In other words, T-valve arm 14A is positioned such that there is a suitable angle elevation $\phi$ between the axis of the T-valve arm 14A and the horizontal.

Figure 2:
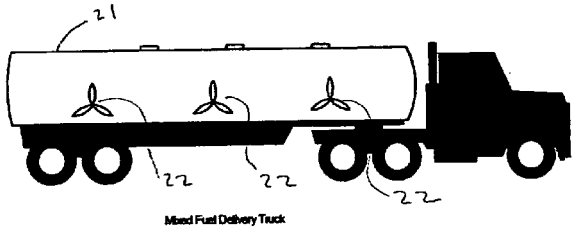
FIG. 2 illustrates one example of blended fuel delivery for the system shown in FIG. 1.

Referring to FIG. 2 there is shown an optional component of the present invention. Mixed fuel delivery truck 21 includes mixing devices 22 for mixing petroleum/vegetable oil. Mixing devices 22 may be any suitable mixing device such as paddle mixers or air bubblers, for example.

Figure 4B:
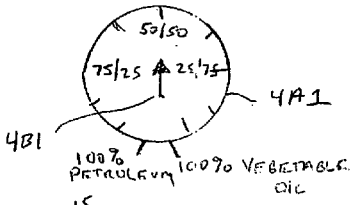
FIG. 4 illustrates one example of an alternate embodiment of the present invention shown in FIG. 1.
FIG. 4A is a pictorial diagram of the controller feature shown in FIG. 4.
Figure 4:
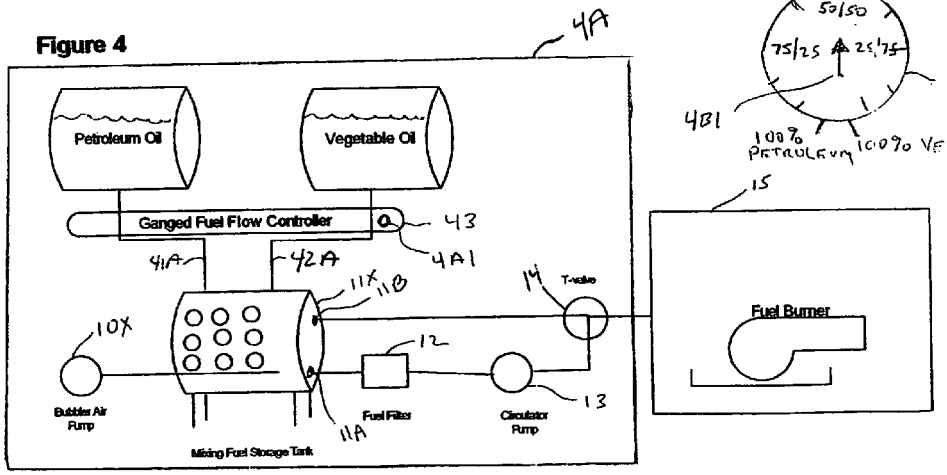

Referring now to FIG. 4, there is shown a pictorial diagram of an alternate embodiment of the blended petroleum/vegetable oil fuel delivery system 4A. Fuel storage tank 11*x* is standard fuel storage tank and may be any appropriate storage tank designed and/or approved by an approving body for the holding of mixed petroleum fuel and vegetable oil.

Storage tank 42 is, a vegetable oil storage tank and may be any appropriate storage tank designed and/or approved by an approving body for the holding of vegetable oil.

Petroleum oil from tank 41 and vegetable oil from tank 42 are flowed though flow pipes 41A and 42A, respectively to mixing fuel tank 11*x*. The flow through each of the flow pipes 41A and 42A is synchronized and controlled by ganged fuel flow controller 43. Fuel controller may be any suitable adjustable controller to set the amount of desired flow mixture into mixing tank 11*x*.

An example flow controller knob 4A1 is show in FIG. 4B. Selector 4B1 is rotated to any desired petroleum/vegetable oil mixture. Thus, it will be appreciated that the embodiment shown in FIG. 4 allows for the separate purchase and storage of petroleum oil and vegetable oil.

Mixing tank 11*x* stores and mixes and stores the petroleum and vegetable oil as described earlier. However, the tank 11*x* may be suitably sized for mixing and storing the petroleum/vegetable oil blend based upon operational requirements, e.g., number of gallons used per day and any desired blended reserve.

Likewise, mixer air pump 10*x* may also be suitably sized for a smaller mixing tank 11*x*. It will be appreciated that mixing may be accomplished by any suitable means.

The diagrams depicted herein are just examples. There may be many variations to these diagrams described therein without departing from the spirit of the invention. All of these variations are considered a part of the claimed invention. For example, one variation may be to use components adapted to use transesterified vegetable oil.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A system for blending, storing, and delivering blended petroleum based fuel and vegetable based fuel to a fuel burner, the system comprising:

a blended fuel storage tank for storing the blended petroleum based fuel and vegetable based fuel, wherein the blended fuel storage tank comprises:

at least one input port;

at least one output port;

at least one fuel filter connectable to the at least one output port for filtering water and contaminants from the blended petroleum based fuel and vegetable based fuel;

at least one circulator pump connectable to the at least one fuel filter for circulating the blended petroleum based fuel and vegetable based fuel;

at least one T-valve connectable to the at least one circulator pump and to the at least one input port wherein the at least one T-valve comprises:

a first leg, wherein the first leg is connectable to the at least one circulator pump;

a second leg, wherein the second leg is connectable to the at least one input port; and a third leg, wherein the third leg is connectable to the fuel burner, wherein a longitudinal axis of the third leg is adapted to an angle greater than zero degrees and between the longitudinal axis and the horizontal to allow gravity feed of the blended petroleum based fuel and vegetable based fuel not used by the fuel burner to flow back into the center of the T-valve a blending device connectable to the blended fuel storage tank, wherein the blending device is at least one air bubbler; and a blended petroleum based fuel and vegetable based fuel delivery truck for transporting the blended fuel storage tank.

2. The system as in claim 1 wherein the blending device further comprises at least one paddle blender.

3. The system as in claim 1 wherein the blended petroleum based fuel and vegetable based fuel delivery truck further comprises a second blending device connectable to the blended petroleum based fuel and vegetable based fuel delivery truck.

4. The system as in claim 3 wherein the second blending device is at least one second air bubbler.

5. The system as in claim 3 wherein the second blending device is at least one second paddle blender.

6. A system for blending, storing, and delivering blended petroleum based fuel and vegetable based fuel to a fuel burner, the system comprising:

a blended fuel storage tank for storing the blended petroleum based fuel and vegetable based fuel, wherein the blended fuel storage tank comprises:

at least one input port;

at least one output port;

at least one fuel filter connectable to the at least one output port for filtering water and contaminants from the blended petroleum based fuel and vegetable based fuel;

at least one circulator pump connectable to the at least one fuel filter for circulating the blended petroleum based fuel and vegetable based fuel;

at least one T-valve connectable to the at least one circulator pump and to the at least one input port, and wherein the at least one T-valve comprises:

a first leg, wherein the first leg is connectable to the at least one circulator pump;

a second leg, wherein the second leg is connectable to the at least one input port; and a third leg, wherein the third leg is connectable to the fuel burner, wherein a longitudinal axis of the third leg is adapted to an angle greater than zero degrees and between the longitudinal axis and the horizontal to allow gravity feed of the blended petroleum based fuel and vegetable based fuel not used by the fuel burner to flow back into the center of the T-valve; and a blending device connectable to the blended fuel storage tank, wherein the blending device is at least one air bubbler.

7. The system as in claim 6 wherein the blending device further comprises at least one paddle blender.

8. The system as in claim 6 wherein the blending device further comprises at least one splash mixer.

9. The system as in claim 8 further comprising a blended petroleum based fuel and vegetable based fuel delivery truck.

* * * * *